United States Patent [19]

Schiazza et al.

[11] Patent Number: 5,014,388

[45] Date of Patent: May 14, 1991

[54] BATTERY POWERED VACUUM CLEANER

[75] Inventors: Alfred Schiazza, Bloomington; Arnold L. Sepke, Hudson, both of Ill.

[73] Assignee: White Consolidated Industries, Inc., Cleveland, Ohio

[21] Appl. No.: 352,210

[22] Filed: May 15, 1989

[51] Int. Cl.[5] ..... A47L 9/28

[52] U.S. Cl. ..... 15/339; 15/351; 15/412; 15/DIG. 1

[58] Field of Search ..... 15/350, 351, 339, DIG. 1, 15/412

[56] References Cited

U.S. PATENT DOCUMENTS

| | | | |
|---|---|---|---|
| 4,173,809 | 11/1979 | Ku | 15/319 |
| 4,369,543 | 1/1983 | Chen et al. | 15/319 |
| 4,835,409 | 5/1989 | Bhagwat et al. | 15/DIG. 1 |

*Primary Examiner*—Chris K. Moore

*Attorney, Agent, or Firm*—Pearne, Gordon, McCoy & Granger

[57] ABSTRACT

This invention relates to improvements in vacuum cleaners, and is more in particular directed to the provision of a battery powered upright vacuum cleaner.

13 Claims, 14 Drawing Sheets

FIG.6
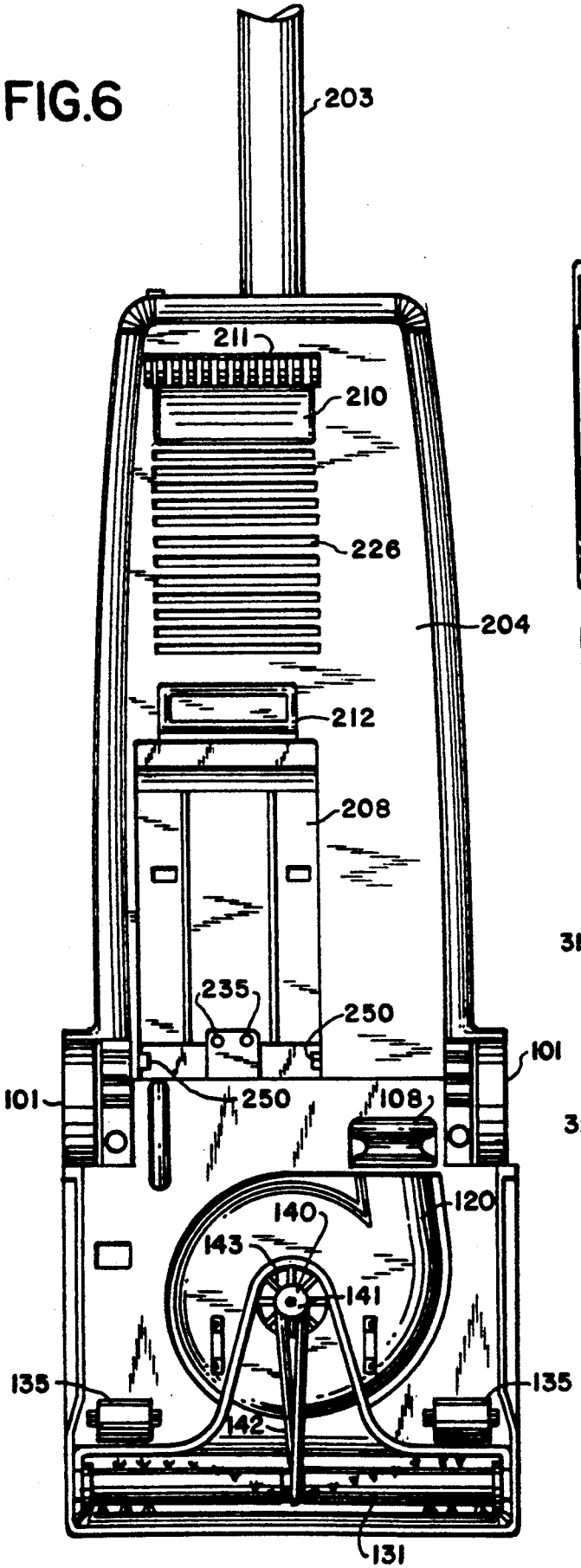
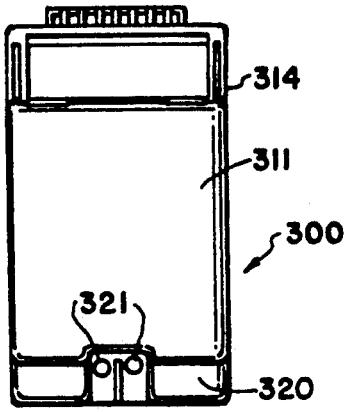
FIG.19
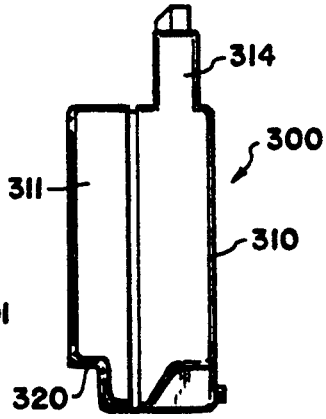
FIG.20

FIG.8A
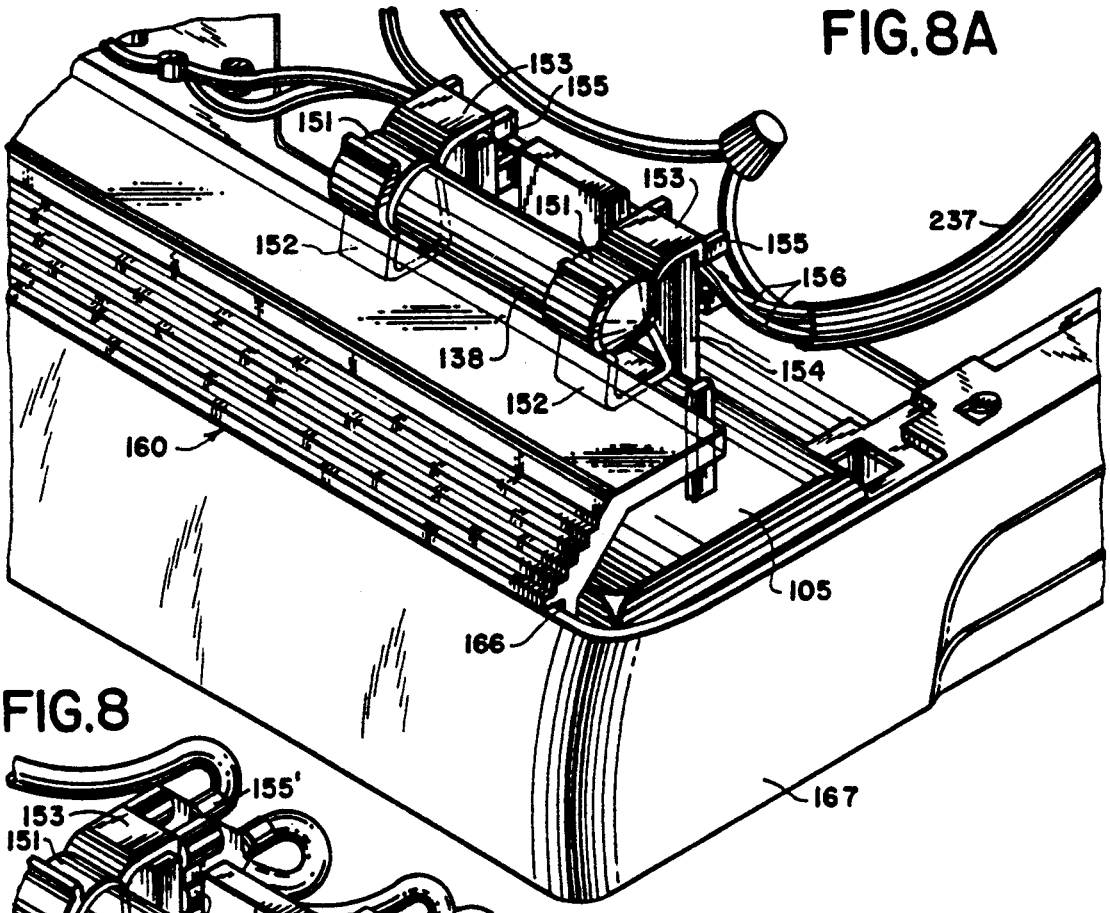
FIG.8
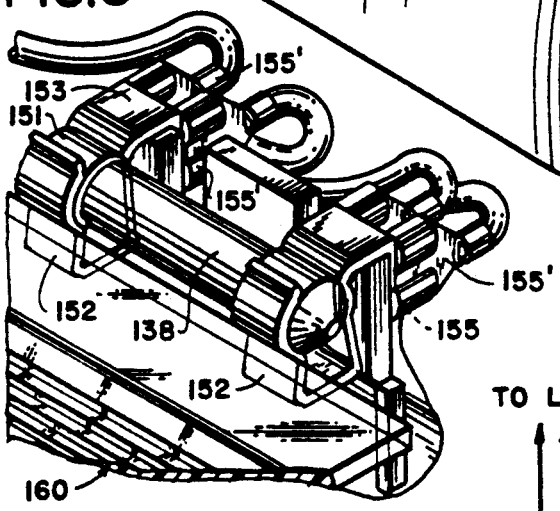
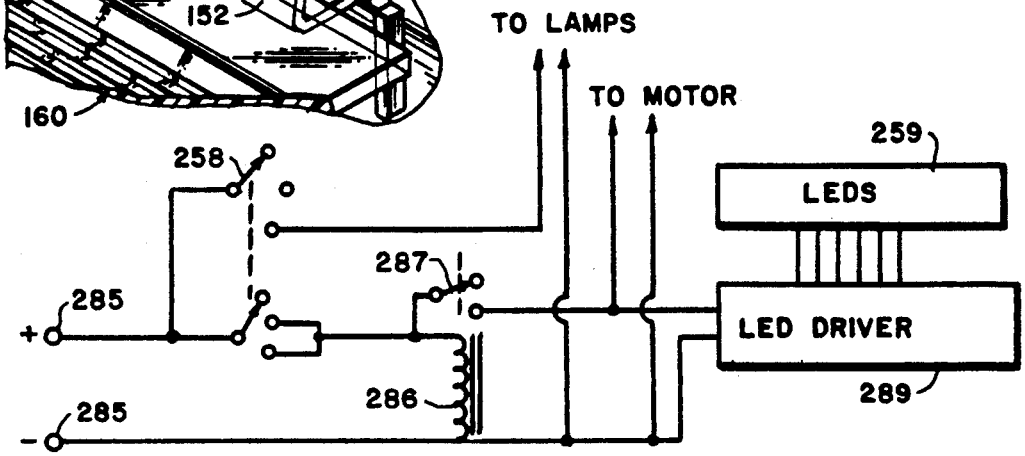
FIG.29

BATTERY POWERED VACUUM CLEANER

BACKGROUND OF THE INVENTION

In the past it has been common to provide portable vacuum cleaners with batteries. This technique has not been successfully employed in upright cleaner of the type having a handle assembly pivotted to a floor engaging unit, however, such vacuum cleaners hence conventionally requiring the interconnection of the cleaner with the power mains during use. While upright vacuum cleaners have many advantages, such as greater cleaning power, this interconnection creates problems in the use of the cleaner since it limits the distance that the cleaner may be used from an outlet, and the interconnecting cord tends to become tangled with furniture or the like during use.

SUMMARY OF THE INVENTION

The present invention is therefore directed to the provision of an upright vacuum cleaner that overcomes the above disadvantages.

Briefly stated, in accordance with the invention, a vacuum cleaner is provided having a floor engaging unit and a handle assembly pivotally mounted thereto.

The floor engaging unit includes a vacuum pump formed by a motor mounted to a base, the base having airflow ducts formed therein, for directing air from an inlet nozzle to an outlet tube. One or more lamps are provided within the floor engaging unit for directly light forwardly of the vacuum cleaner through a horizontally elongated lens. The lens has a front surface with horizontal grooves formed therein shaped to direct the light downwardly to a determined location in front of the vacuum cleaner.

The handle assembly includes a housing pivoted to the floor engaging unit, and a handle extending from the opposite end thereof. A rigid or semirigid dirt tube extends longitudinally in one side of a recess in one side of the housing, and has a lower end coupled via a flexible tube to the outlet of the floor engaging unit. The flexible tube may be a separate tube or it may be formed integrally with the dirt tube, having thinner walls than the dirt tube to retain its flexibility. The dirt tube has a forwardly extending port in its other end to receive a disposable dust bag adapted to be removably assembled in the front recess. A removable cover covers the front recess to permit access to the dust bag.

A further recess is provided in the rear of the housing for releasably receiving a rechargeable sealed lead acid battery assembly box, the battery being adapted to being recharged either attached to the vacuum cleaner or removed therefrom. The battery assembly box includes the battery, a recharging circuit including a recharging light, and a circuit breaker that is accessible at the rear of the vacuum cleaner for being manually reset.

A control board is provided at the upper end of the housing, including a switch enabling operation of the machine either with or without use of the lights. An indicator, such as a row of LEDs is also provided on the control board, to indicate the charge condition of the batter to the user.

BRIEF DESCRIPTION OF THE DRAWING

In order that the invention may be more clearly understood, it will no be disclosed in greater detail with reference to the accompanying drawing, wherein:

FIG. 6 is a rear plan view in accordance with FIG. 5, with the bottom cover and battery assembly removed;

FIGS. 8 and 8A are alternate enlarged perspective views of a portion of the floor engaging unit with the hood removed;

FIG. 19 is a front view of the battery assembly;

FIG. 20 is a side view of the battery assembly;

FIG. 29 is a circuit diagram of the control circuit board of the vacuum cleaner;

DETAILED DISCLOSURE OF THE INVENTION

Figure 1:
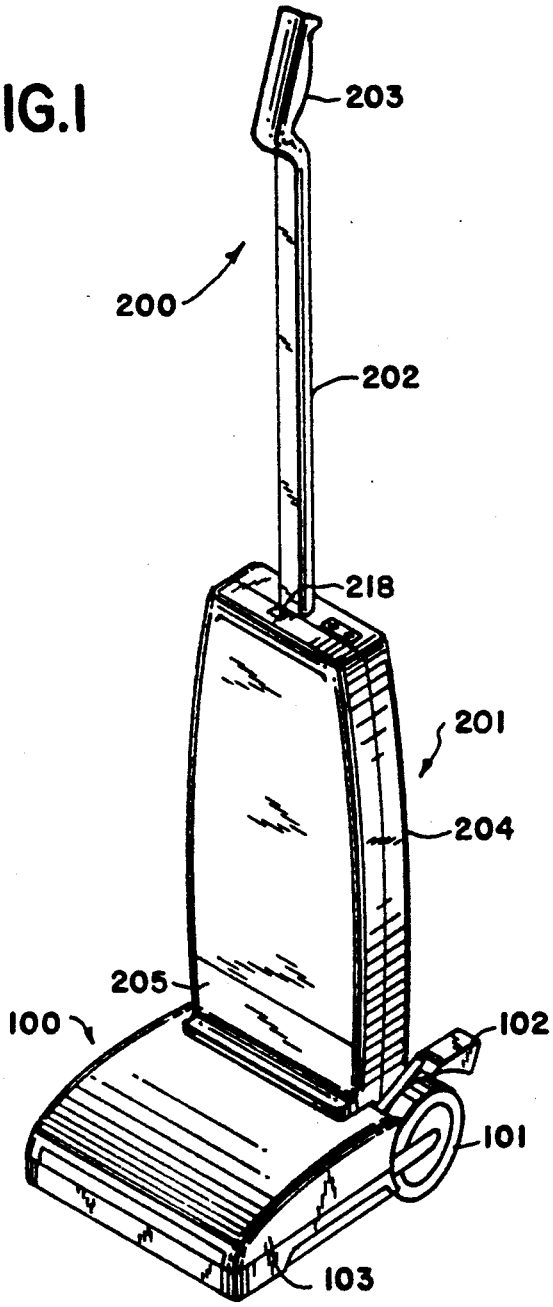
FIG. 1 is a perspective view of a vacuum cleaner in accordance with the invention.

As illustrated in FIG. 1, the preferred embodiment of a vacuum cleaner in accordance with the invention is comprised of a floor engaging unit 100 which encloses the vacuum cleaner motor as will be discussed. The unit 100 is provided with a pair of rear wheels 101, a lever 102 for enabling the latching of the handle assembly in desired positions, and a hood 103. The vacuum cleaner further includes a handle assembly 200 pivotally mounted to the rear of the floor engaging unit 100, the handle assembly including a housing 201 whose lower end is pivoted to the floor engaging unit, a handle 202 extending from the opposite end of the canister, and a hand grip 203 preferable shaped to enable a user to comfortably grip this element. The housing 201 has a body portion 204 at the rear side thereof, the front of the housing including a bottom front cover 205 and a removable upper front cover 206. The lip 211 preferably projects rearwardly of the body a sufficient distance that, when the vacuum cleaner is on a floor and the handle assembly is positioned horizontally, the lip 211 will engage the surface of the floor to prevent the handle 202 and grip 203 pressing against the floor. This feature minimizes danger of damage to the handle assembly by stressing the handle.

Figure 2:
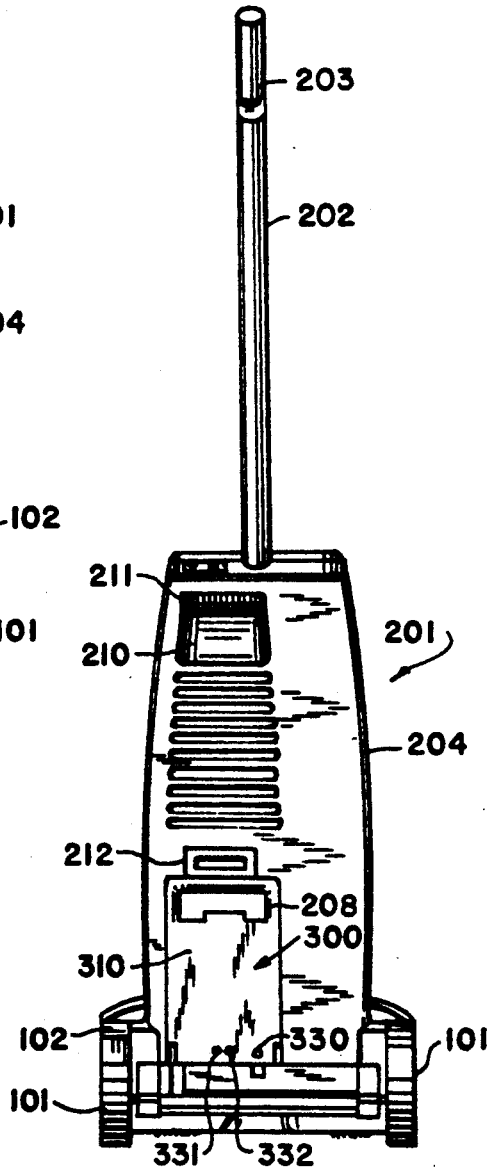
FIG. 2 is a rear view of the vacuum cleaner of FIG. 1.

As illustrated in FIG. 2, showing a rear view of the vacuum in FIG. 1, the rear of the body 204 includes a recess 208 for receiving a battery assembly 300, vents 209 for venting air from the housing and a recess 210 at the upper portion thereof, having an upper lip 211, to facilitate carrying of the vacuum cleaner. FIG. 2 also shows the latch 212 permitting release of the battery assembly.

Figure 3:
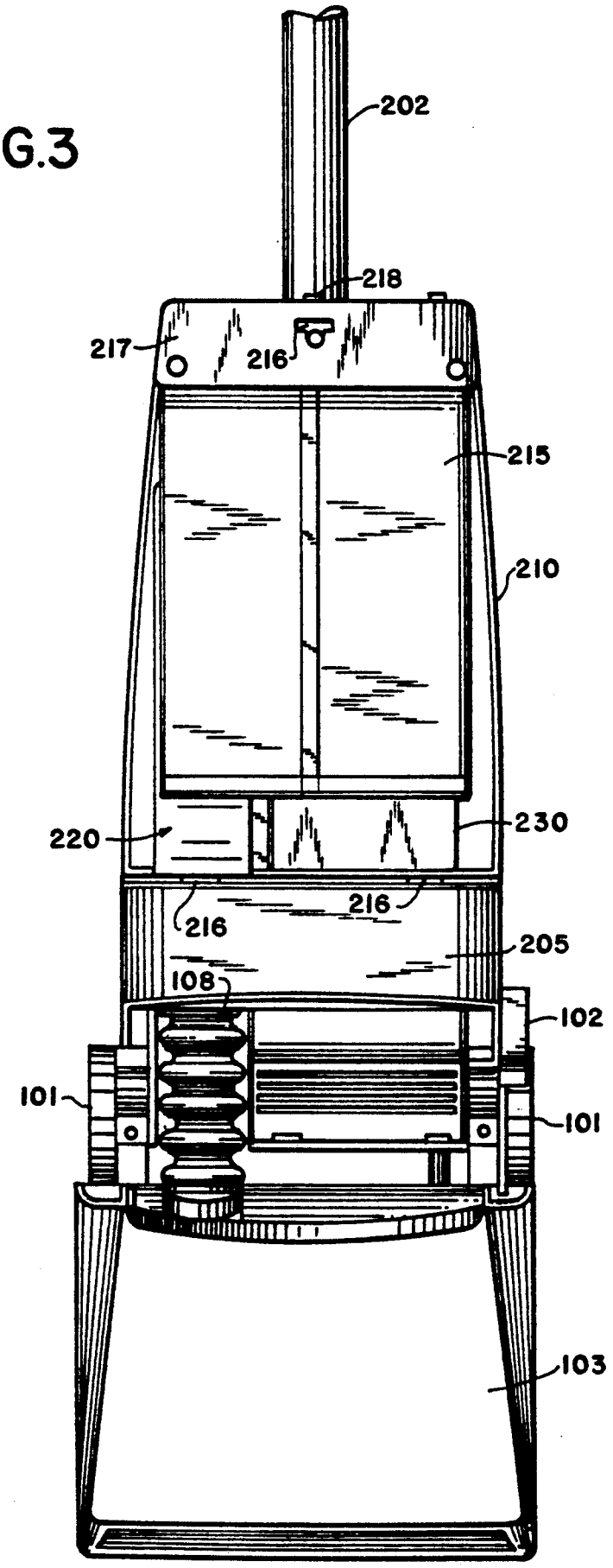
FIG. 3 is a front plan view of the vacuum cleaner of FIG. 1, with the front cover removed.
Figure 7:
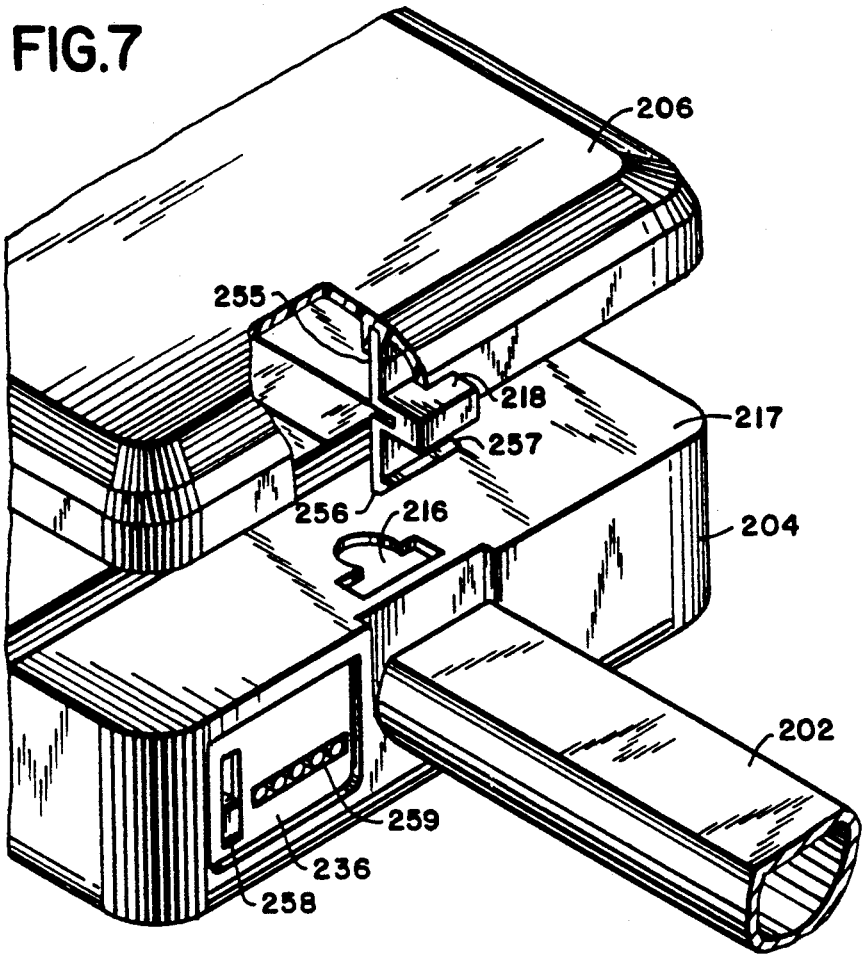
FIG. 7 is an enlarged perspective view of a portion of the handle assembly with the front cover partially opened.

FIGS. 1 and 2 illustrate the handle assembly of the vacuum cleaner in an upright position. FIG. 3 illustrates the vacuum cleaner with the handle assembly in a generally horizontal position, with the upper front cover removed, to show a porous bag 215 fit therein. The upper front cover of the vacuum cleaner is readily removable by the user to permit changing of the bag. The front cover 206 may be removably held to the housing 204 by any convenient means. For example, the cover 206 may have downwardly extending projections (not illustrated) engagable with apertures 216 at the top of the bottom cover 205. The top of the front cover 206 may be held by an internal projection positioned to enter the slot 216 in a handle folding assembly plate 217 affixed to the top of the housing, as seen in FIG. 7, with a spring loaded button 218 at the top of the housing engaging the projection in the upper position of the button.

Figure 4:
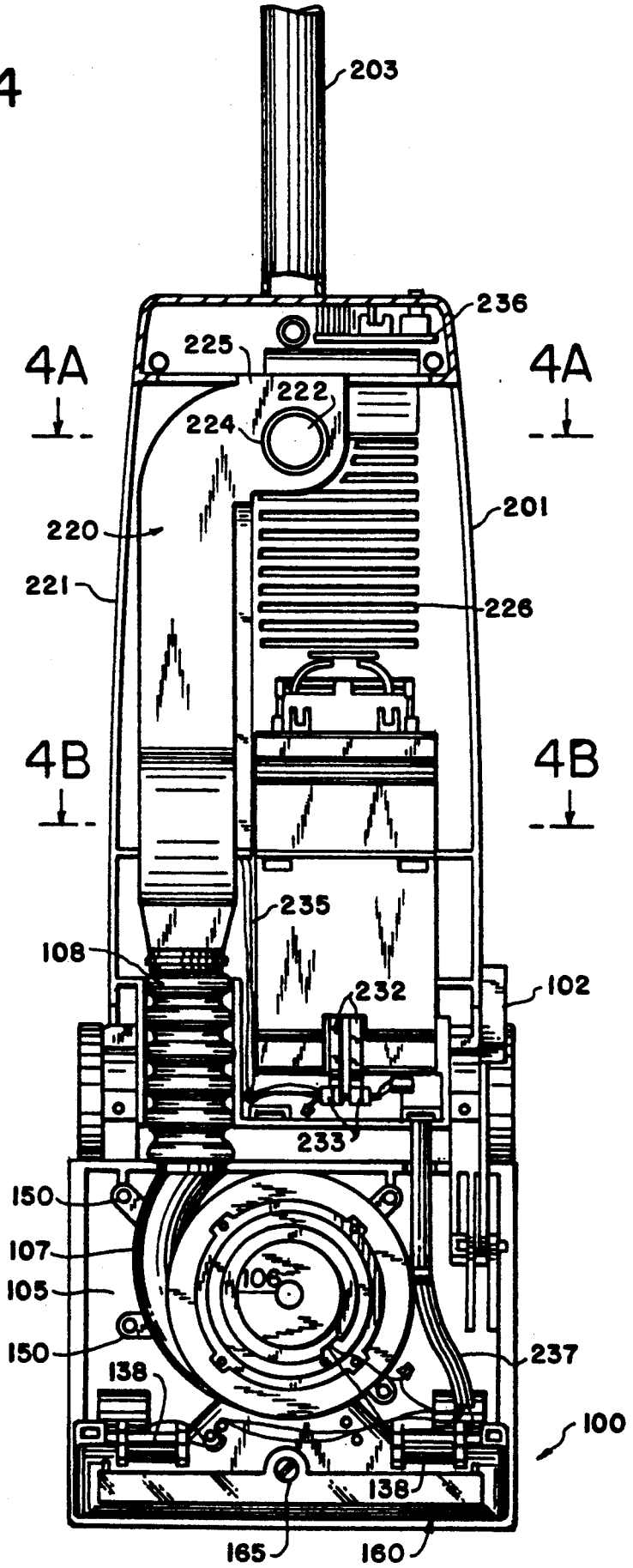
FIG. 4 is a front plan view in accordance with FIG. 3, with the hood and bottom front covers also removed.

FIG. 4 illustrates the vacuum cleaner in the same position as FIG. 3, but in this figure the lower cover 205 and hood 103 have also been removed, the upper portion being partially in section, and the housing is illustrated without the porous bag 215.

As illustrated in FIG. 4, a base 105, molded for example from a plastic material, supports on its top surface a motor 106 with a vertical shaft. The motor 106 rotates a fan (not illustrated in FIG. 4), to exhaust air by way of a duct 107 formed in the base 105. The rear end of the duct is connected to a flexible tube 108, the other end of the tube 108 joining one end of the dirt tube 220 mounted in the body portion of the housing 201. The dirt tube 220 extends along one side 221 of the housing, with the other end thereof having a forwardly directed port 222 with a cylindrical extension 224 for receiving the porous bag 215 of FIG. 3. The inter-connection between the porous bag and the cylindrical extension 224 may be conventional. While the dirt tube, for example of a rigid plastic material, may be separately formed from the flexible tube 108, it is advantageous that these elements be formed as a single plastic unit. In this event the necessary flexibility of the tube 108 may be obtained by decreasing the wall thickness in this part of the combined structure. Decreased wall thickness does not incur any risk of collapse of the tube since the tube is under positive pressure in use. The upper end of the dirt tube 220 may have a projection 225 adapted to be held by the plate 217 of FIG. 3.

Air vents 226 are provided in the rear wall of the body portion 204 laterally of the dirt tube 220, at the upper end of the body portion 204. A battery receptacle 230 is provided laterally of the dirt tube in the lower region of the body portion, the battery receptacle 230 being formed in the body portion 204 and being opened rearwardly of the body portion, as will be discussed. Spring fingers 231 of a latch for holding the battery assembly are visible in this view of the housing. A pair of spring contact fingers 232 are mounted adjacent the bottom of the receptacle 230, at fixed positions 233, to interconnect the terminals of the battery assembly with the internal components of the vacuum cleaner. Thus, the contact fingers 232 are connected by way of leads 235 to a control board 236 mounted at the upper end of the body portion 204, and the contact fingers 232 are connected by leads extending through a flexible conduit 237 to the motor 106 and lamps 238 in the floor engaging unit 100. The conduit 237 may be held to the base 105 by a clamp molded on the base 105.

Figure 4A:
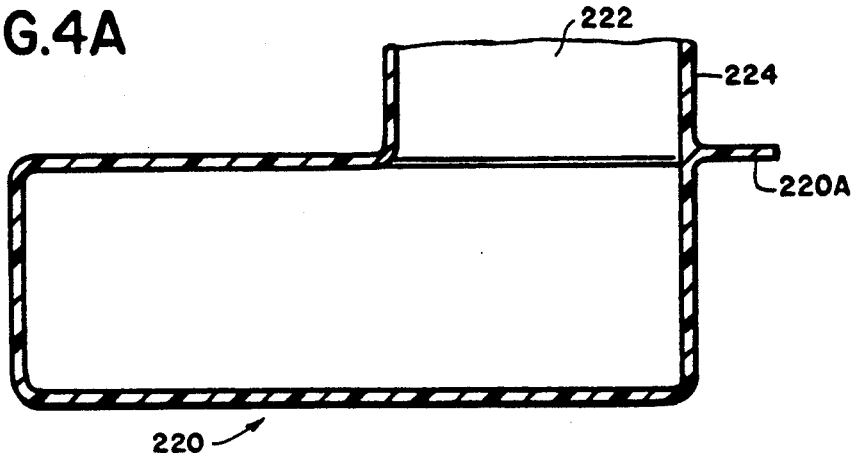
FIG. 4A is a cross sectional view of the dirt tube (only) taken along the line 4A—4A of FIG. 4.
Figure 4B:
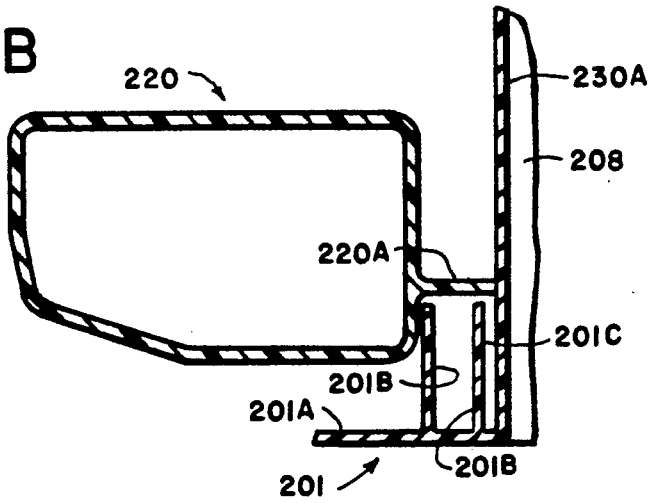
FIG. 4B is a cross sectional view of the dirt tube and a part of the housing taken along the line 4B—4B of FIG. 4.

As illustrated in FIGS. 4, 4A and 4B, the dirt tube 220 has a lateral flange 220A internally of the housing, and spaced from the rear wall 201A of the housing. This flange, in combination with suitable walls extending from the rear wall of the housing, defines a channel 201C through which the leads extend from the connectors 232 to the control board 236. For example, as seen in FIG. 4B, the side wall 230A of the receptacle 230 and additional short walls 201B are laterally spaced apart to define the channel 201C, the channel being covered by the flange 220A. The dirt tube thus serves the additional function of defining part of the channel 201C for protecting the leads as they extend through the housing.

Figure 5:
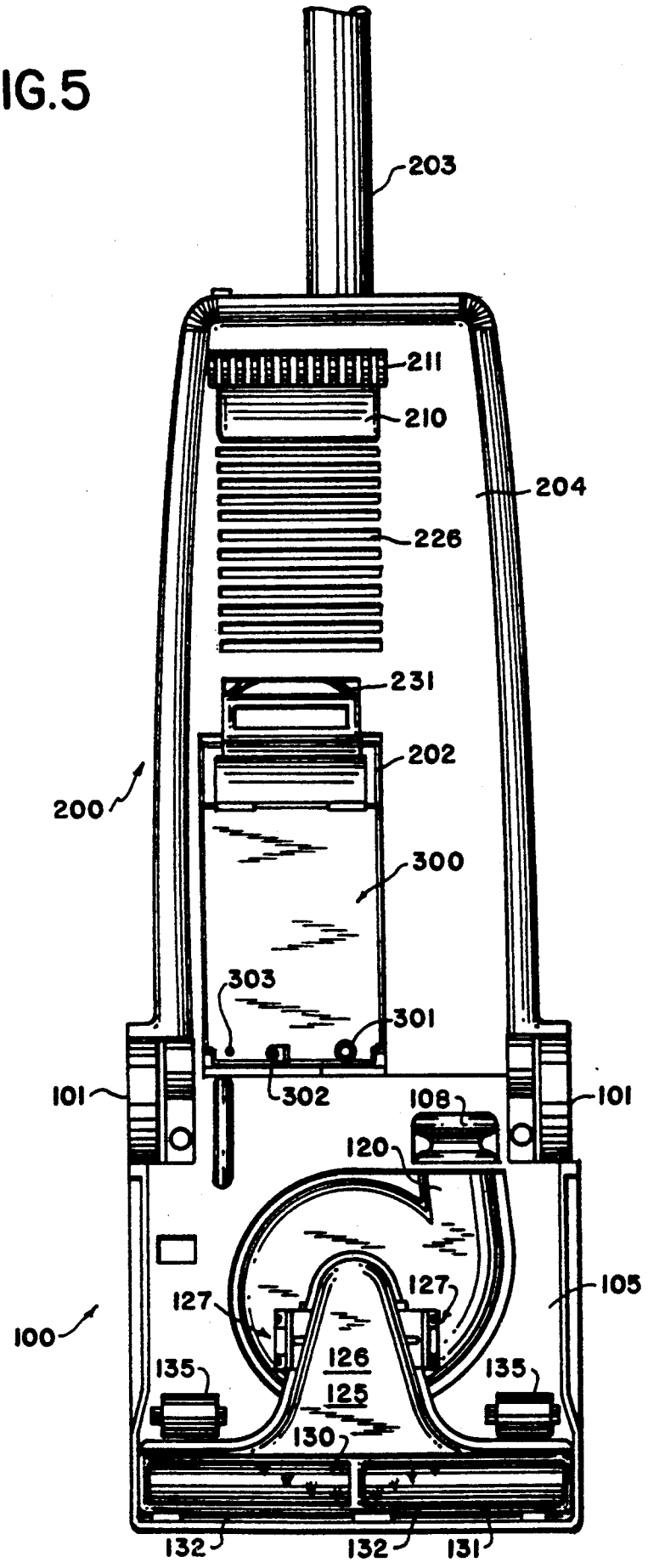
FIG. 5 is a rear plan view of the vacuum cleaner.

As illustrated more clearly in FIG. 5, a spiral duct 120 is also formed in the bottom of the base 105, forming part of the duct 107, for connection to the flexible tube 108. The bottom cover 125 has a rearward extension 126 aligned with the axis of the motor, and is releasably held to the base 105 by a pair of catches 127. The forward portion of the bottom cover 125 is provided with apertures 130 for receiving dust laden air, FIG. 5 illustrating a portion of a conventional brush roller 131 through the apertures 130. The front of the cover 125 may be held to the base by projections 132. A pair of front wheels 135 may be mounted to the under side of the base 105, rearwardly of the apertures 130 and laterally of the extension 126.

The battery assembly 300 has a charging socket 301 on its rear side for receiving an electric plug for charging the batteries within the battery assembly. The battery assembly may also have a circuit breaker button 302, and an LED 303 for indicating that the battery is being charged.

As illustrated in FIG. 6, with the bottom cover 125 of FIG. 5 removed, the shaft 140 of the motor is visible, the shaft carrying a pulley 141. The belt 142 extending around the pulley extends forwardly around the brush roller 131 in conventional manner, to rotate the brush roller during operation of the vacuum cleaner. The fan 143 is also visible in this view, the fan directing air from the region of the dust roller upwardly into the duct 120 for carrying dust to the dust bag 215 of FIG. 3.

FIG. 6 also shows the recess 208 with the battery assembly removed. In this view the contact fingers 232, which extend into the recess 208, are visible at the bottom of the recess. In addition, a pair of projections 250 are molded to extend laterally into the recess 208, near the lower end thereof, to enable installing the battery assembly in the recess.

As illustrated in FIG. 7, wherein the upper end of the removable front cover 206 is illustrated spaced from the body portion 204, the button 218 is illustrated as affixed to a resilient plate 255 held in a slot within the cover 206. The button 218 extends through an aperture in the upper end of the cover 206, and carries a latch plate 256 having an enlarged end 257 adapted to be received in the slot 216 of the body portion 204. The enlarged end 257 hence catches under the plate 217 to hold the cover 206 against the body portion 204, being releasable by depression of the button 218 to permit separation of these members.

As further illustrated in FIG. 7, the control circuit board 203 includes a switch 258 for controlling the operation of the vacuum cleaner, as well as a plurality of indicators such as LEDs 259 for indicating the operating condition of the cleaner.

FIGS. 8 and 8A are alternate perspective views of a front corner of the floor engaging unit, partially in section, with the cover removed. As illustrated, the lamp 138 is of the cylindrical type, for example an automotive lamp, having terminals 151 at opposite ends thereof received in metal clips 152. The clips 152 have U-shaped brackets 153 fit over post 154 molded to the base 105, the brackets 153 being shaped to be held to the post 154. The brackets 153 carry connectors 155,155, adapted to receive and contact the wires 156 in cable 237, in order to facilitate the wiring of the vacuum cleaner. The lamps may be controlled at selective positions of the switch 258 of FIG. 7. While one lamp is illustrated in FIG. 8, it is apparent that a further lamp is mounted in a similar manner on the other side of the base, as illustrated in FIG. 4.

The mounting of the lamp as illustrated in FIG. 8, is relatively close to the base 105, in order to eliminate the necessity for increase in the height of the floor engaging unit due to the provision of the lamps. The lamps 138 are horizontally mounted, with light being directed to an elongated lens 160 mounted to the floor engaging unit forwardly of the lamp. The lens 160, as illustrated in FIGS. 4 and 8–12, extends for substantially the width of the floor engaging unit, and has a front inclined portion 161 joined to a substantially horizontal upper portion 162. A projection 163 centrally of the lens has a slot 164 for receiving a mounting screw 165 or the like (FIG. 4), for holding the lens to a post or the like extending from the base 105. The lower portion of the lens is held by a lip 166 extending downwardly from the inclined portion 161, for example to engage a base strip 167 extending around the base 105 as illustrated in FIG. 8.

Figure 12:
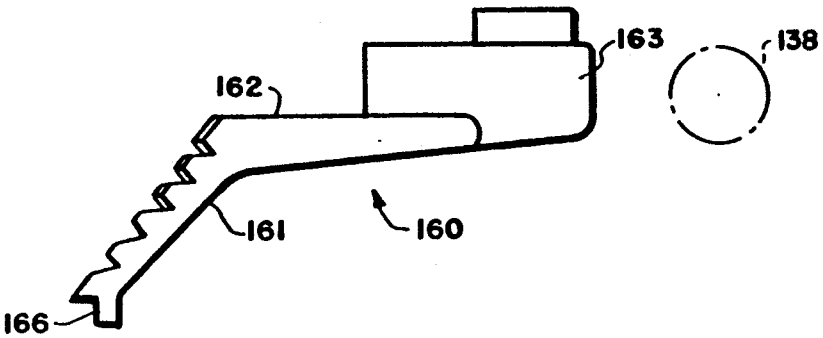
FIG. 12 is an end view of the lens of FIG. 9.
Figure 11:
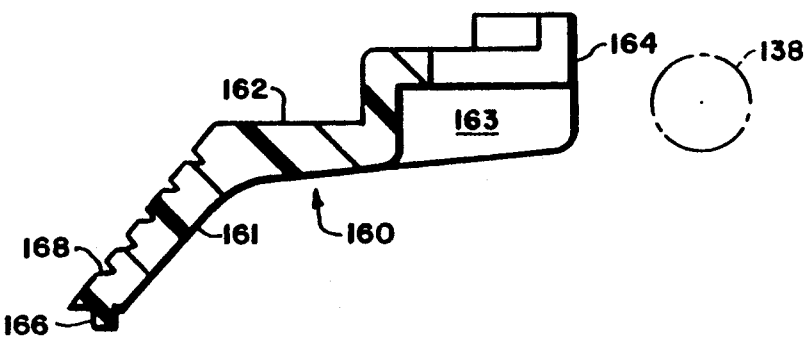
FIG. 11 is a cross sectional view of the lens of FIG. 9 taken along the lines 11—11.

The lens 160 is formed of a transparent plastic material, and the front of the inclined portion 161 is formed with horizontally extending light deflecting grooves 168. As illustrated in FIGS. 11 and 12, the lamps 138 are positioned at substantially the same height as the top edge lens portion, to direct light into the upper rear edge of the lens. The grooves 168 are shaped to intercept this light and direct it to follow an inclined path to the floor upon which the floor engaging unit rests, for example several feet in front of the floor engaging unit.

In a preferred embodiment of the invention, the lens was of a polycarbonate material, about 0.1 inches thick. The grooves were about 0.045 inches deep, having a bottom angle between the sides of 45 degrees, with the bottom sides of the grooves being at an angle of about 15 degrees to the horizontal. The overall height of the grooved front face of the lens was about ½ inches.

Figure 13:
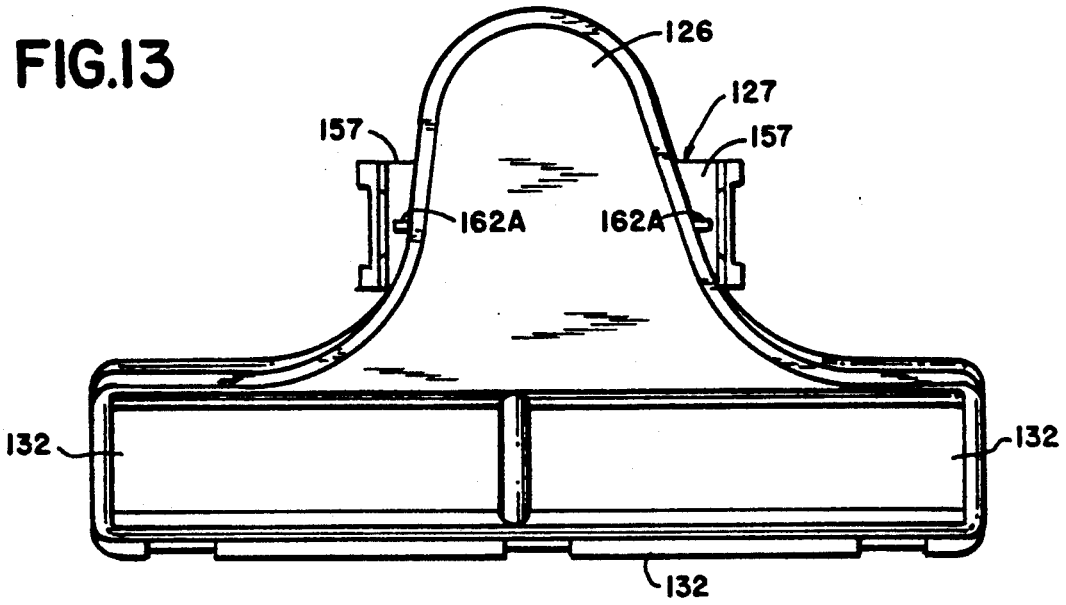
FIG. 13 is a bottom view of the bottom cover of the floor engaging unit.
Figure 14:
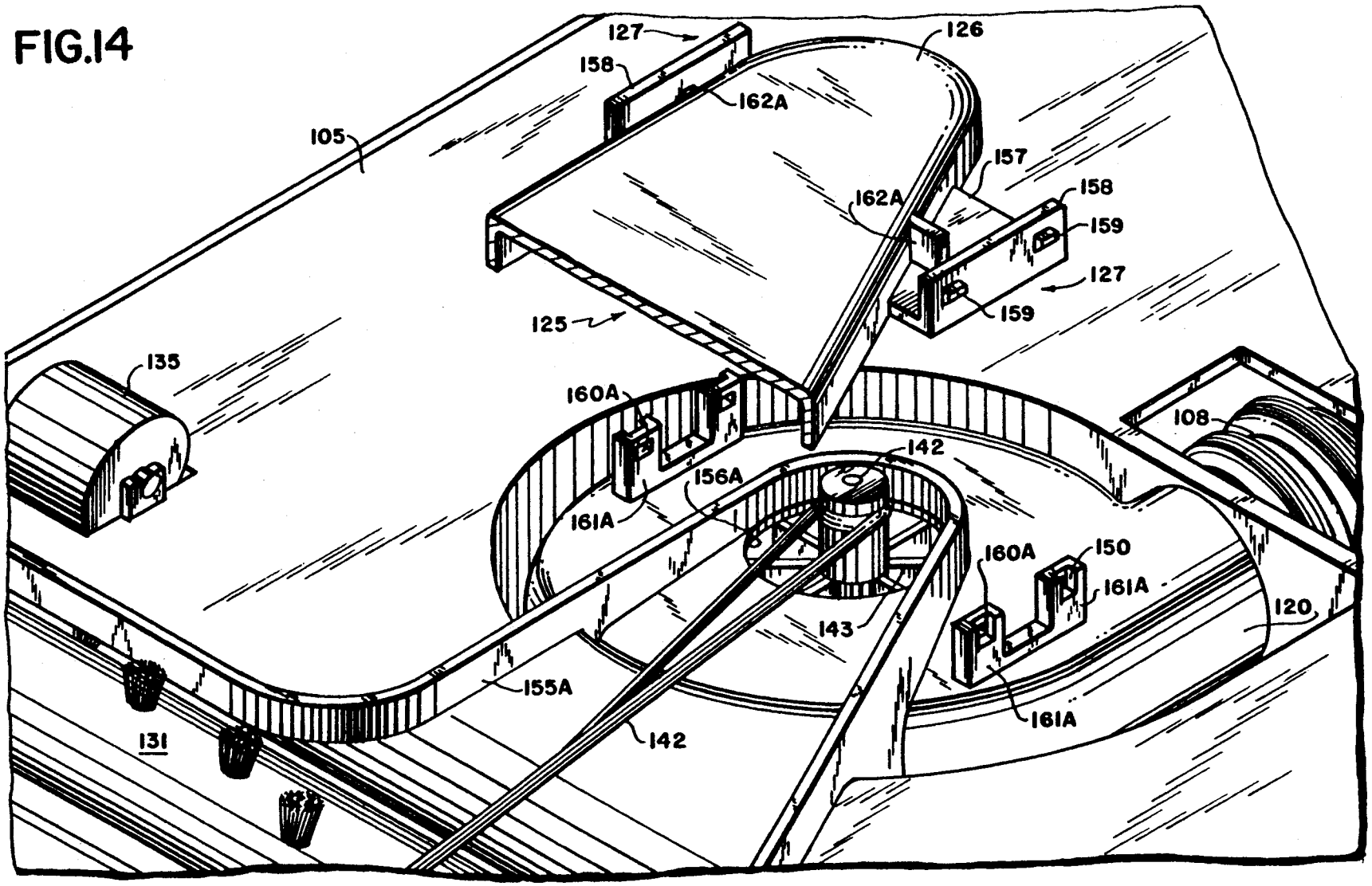
FIG. 14 is an enlarged perspective exploded view of a portion of the bottom of the floor engaging unit illustrating the latch arrangement for the bottom cover.
Figure 15:
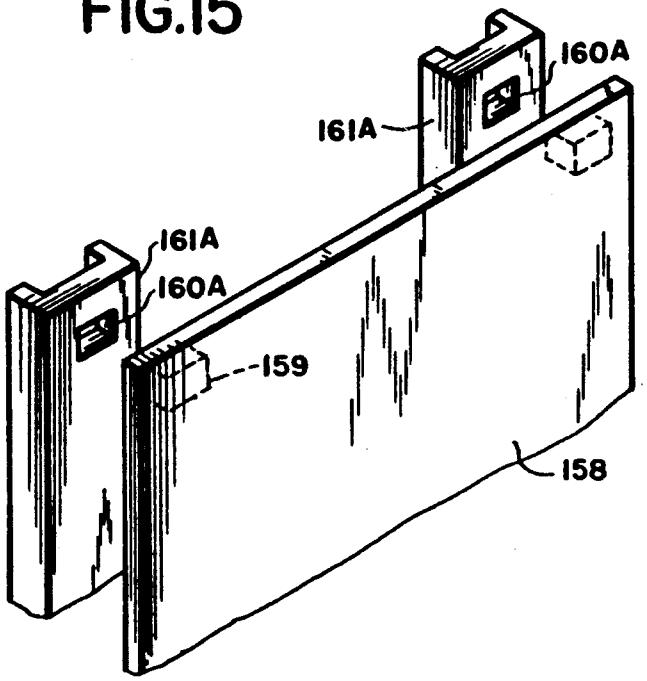
FIG. 15 is an enlarged perspective view of a portion of the arrangement of FIG. 14, illustrating the latch disengagement.
Figure 23:
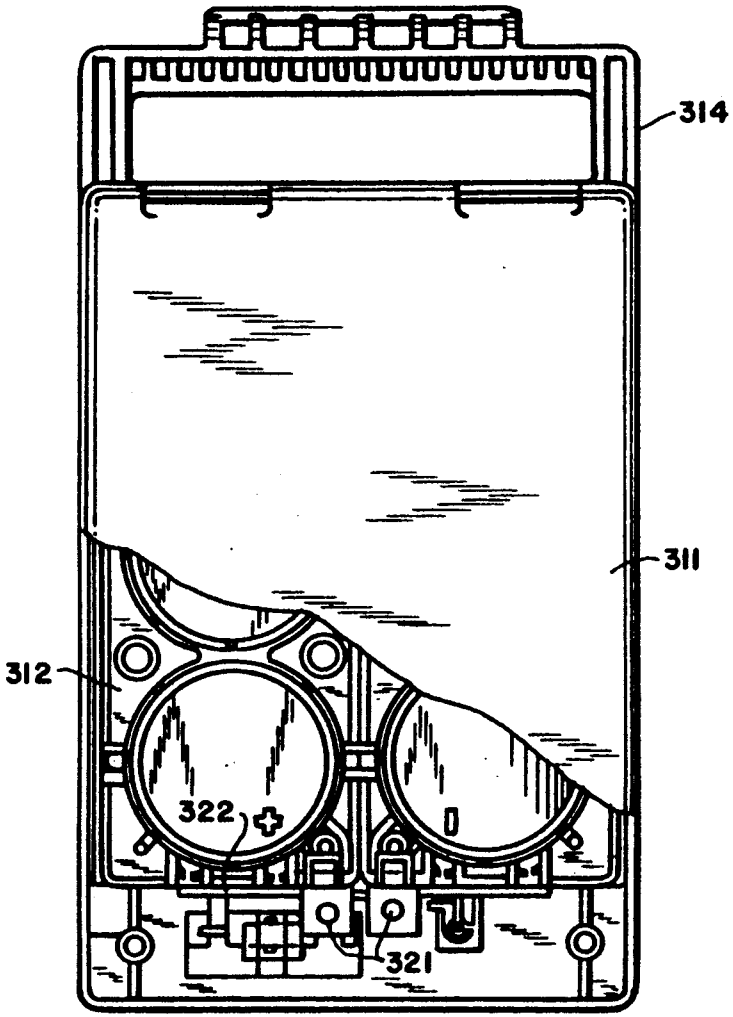
FIG. 23 is a partially sectional front view of the battery assembly illustrating the battery and internal circuit board therein.

FIGS. 13–15 illustrate in greater detail the latching arrangement in accordance with the invention for holding the bottom plate 125 to the base. A wall 155 molded to the base 105 extends downwardly therefrom, having a rear portion surrounding the rear of the aperture 156 through which the shaft of the motor extends, the bottom of the wall being shaped to conform to the outline of the bottom cover 125. The aperture 156 is thus in the bottom wall of the duct 120, wherein the fan 143 rotates, so that the fan draws dust laden air from the nozzle of the vacuum cleaner into the duct via the aperture. The sides of the rear extension 126 of the bottom cover 125 are provided with a pair of laterally extending projections having horizontal portions 157 depending from the rim of the extension and downwardly extending end portions 158. The end portions 158 carry a pair of catch projections 159 directed away from the extension, and adapted to be received in the apertures 160 in posts 161 extending downwardly from the base 105. The projections 157,158 are flexible, being molded with the plastic bottom cover 125, and are resiliently held with their projections 159 within the holes 160. Release of the rear of the bottom cover may be effected in a simple manner by grasping the planar central sections of the end portions 158 between the thumb and fingers and squeezing, while pulling the bottom cover away from the vacuum cleaner.

Support walls 162 may be provided behind the end portions 157, and spaced therefrom, in order to limit the permissible displacement of the end portions 157.

Figure 17:
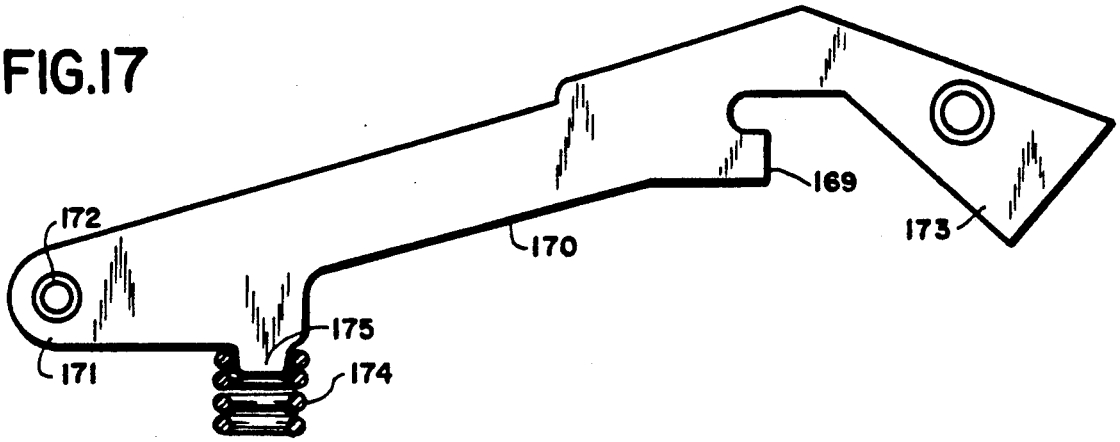
FIG. 17 is a side view of the handle assembly position latch.
Figure 18:
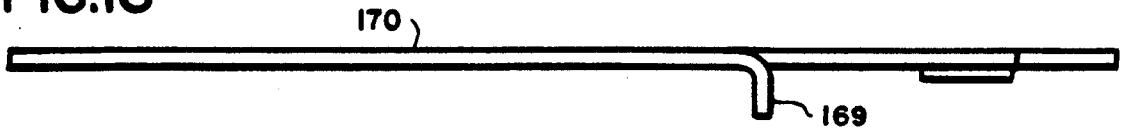
FIG. 18 is an edge view of the latch of FIG. 24.
Figure 16:
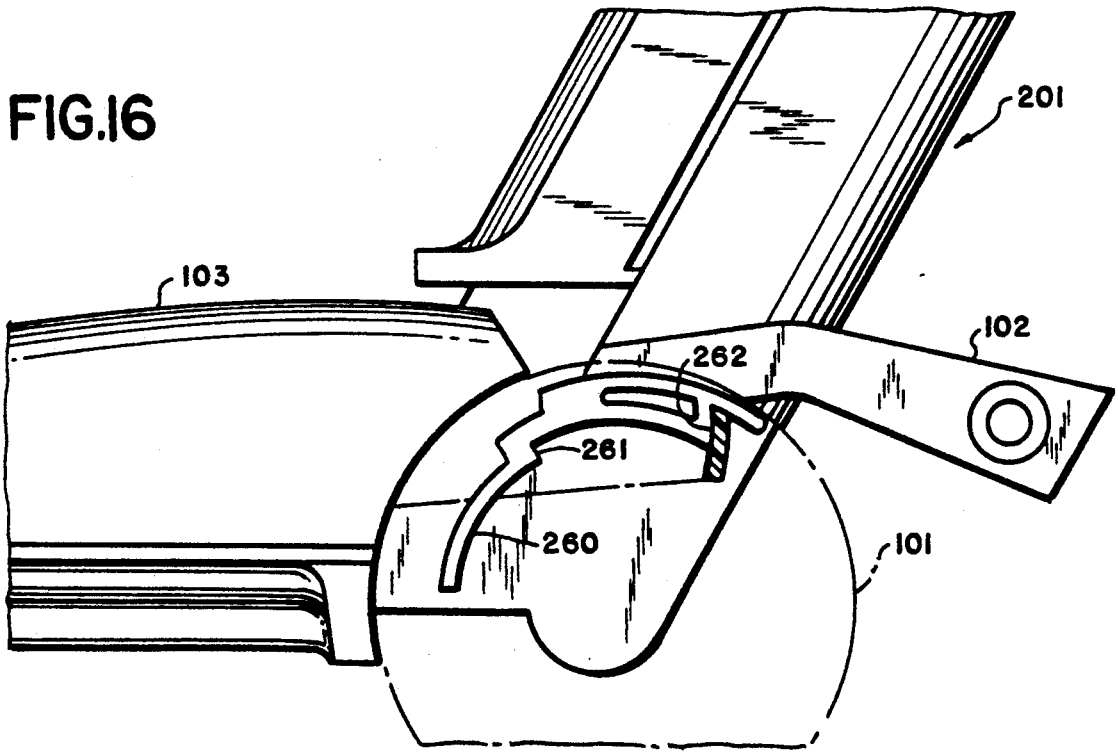
FIG. 16 is a view illustrating the handle assembly latching arrangement of the invention.
Figure 9:
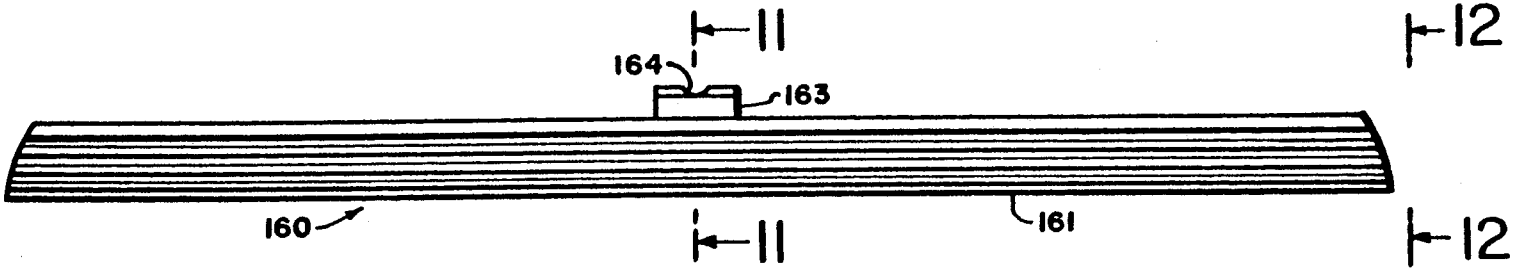
FIG. 9 is a front view of the lens of the floor engaging unit.
Figure 10:
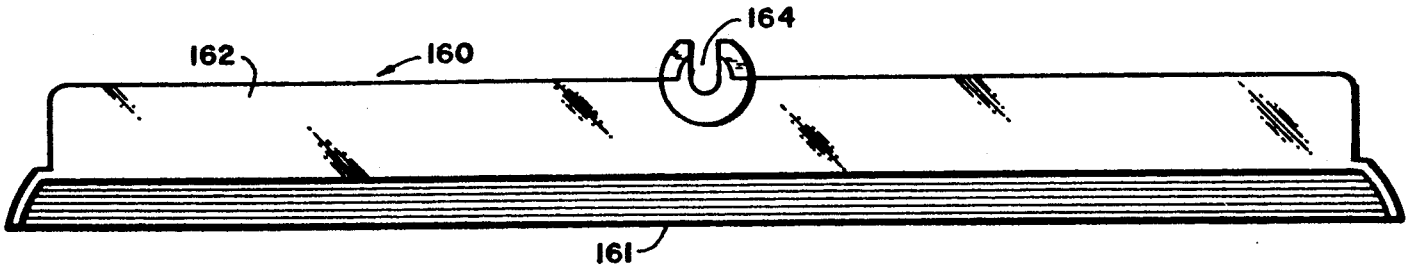
FIG. 10 is a top view of the lens of FIG. 9.

FIGS. 16–18 illustrate the latching arrangement, in accordance with the invention, for enabling the handle assembly to be positioned at selected angles with respect to the horizontal. In this arrangement, an arcuate cam projection 260 is provided on one side of the handle assembly, about 1.5 inches in radius. centered generally on the pivotal axis of the handle assembly. This cam surface is provided with a pair of steps 261, 262 for engaging a tab 169 of the latching lever 170 at different angular displacements of the handle assembly. One end 171 of the latching lever is adapted to be pivotally mounted to a suitable wall of the base 105 forwardly of the pivotal axis of the handle assembly 200, for example at the hole 172. The other end 173 of the lever 170 is adapted to receive a suitable knob or the like for manipulation by the user. The lever 170 and cam surface 260 are preferably positioned at the left side of the vacuum cleaner, and the lever is resiliently biased for rotation in a counter-clockwise direction, as seen in FIG. 17, by any suitable means such as a helical spring 174 extending between a projection 175 on the lever and a fixed position on the base. The resilient bias urges the tab 169 toward the cam surface, to thereby prevent pivotal movement of the handle assembly in the clockwise direction when the tab engages one of the stop surfaces 261, 262. The restraining of the pivoting of the handle assembly is overcome by depression of the end 173 of the lever.

The battery assembly in accordance with the invention is more clearly illustrated in FIGS. 19–23, and is comprised of a box having a rear receptacle 310 joined to a front receptacle 311, for enclosing a battery 312. The battery is preferably a sealed rechargeable lead acid battery, for example a 12 volt 5.0 AH battery 8805 manufactured by Gates Energy Products, Inc. The sides of the rear receptacle 310, at one end thereof, are provided with recesses 313 extending from the rear surface, for receiving the projects 250 in the sides of the battery recess 208 of the housing 201. An extension 314 at the other end of the rear receptacle 310 defines a handle as well as a latch retainer for holding the battery assembly 300 within the recess or the housing 201.

The front receptacle is provided with a step 320 at the lower end thereof, and a pair of battery contacts 321 extend through corresponding apertures in the forwardly facing surface of the step 320 to contact the contacts 232 when the battery assembly is installed. The step 320 serves to inhibit accidental shorting of the battery contacts 321, and thereby discharge of the battery, upon laying of the battery assembly down on a surface. The contacts 321 are connected to a circuit board 322 mounted within the rear and front receptacles 310, 311. The front and rear receptacles may be held together by any conventional technique.

Figure 21:
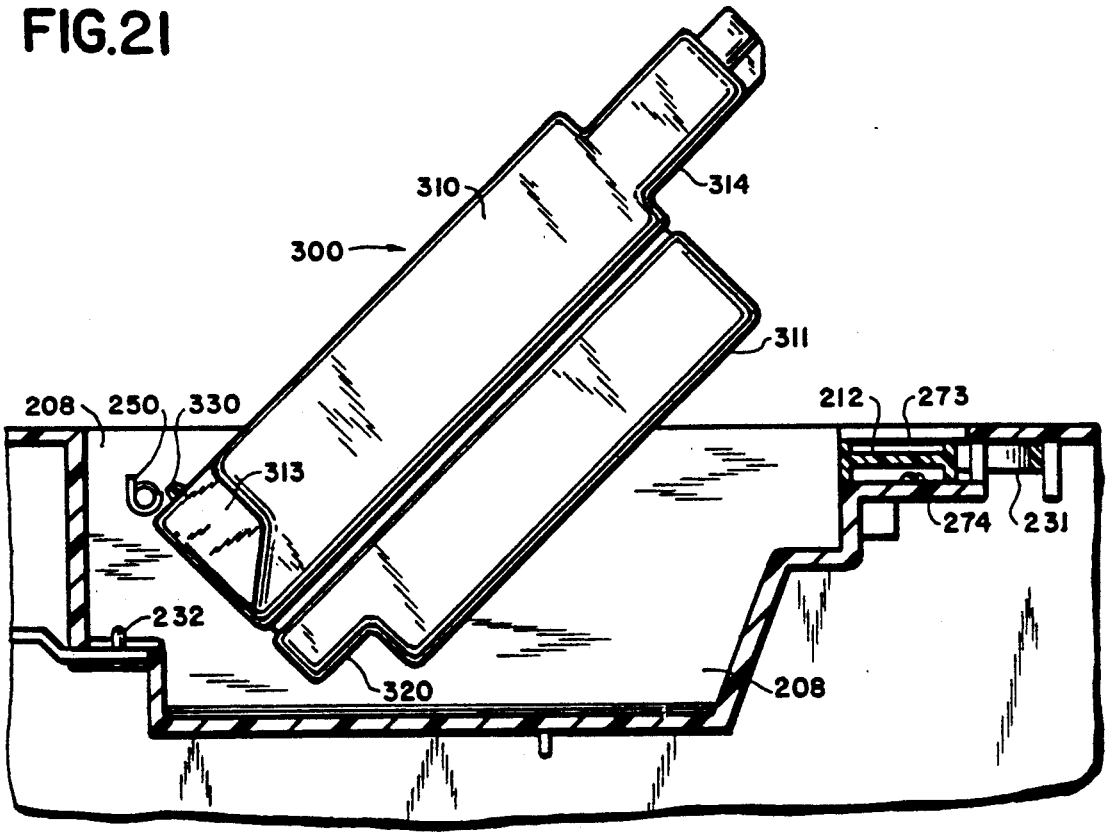
FIG. 21 is an enlarged cross sectional view of a portion of the handle assembly and illustrating the procedure for installing the battery assembly.
Figure 22:
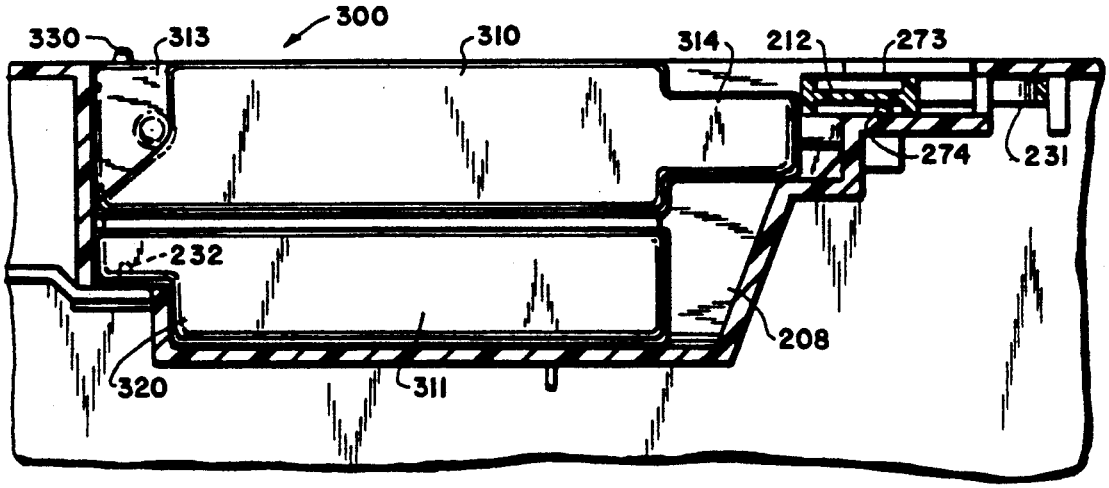
FIG. 22 is a view according to FIG. 21 illustrating the battery assembly in its installed position.

The installation of the battery assembly within the recess is illustrated in FIG. 21, wherein it is seen that the battery is initially held in a slanted position in order to engage the projections in the recesses 313. Using the projects as a pivot, the battery assembly is then pivoted until it is fully received in the recess 208 of the housing 201. The battery assembly is held in place by the latch 212 which is resiliently urged downwardly behind the end of the handle extension 314, as seen in FIG. 22.

As illustrated in FIG. 2, the rear receptacle has a pair of apertures for exposing a charge light 330 and the manual reset button of a circuit breaker 331, as well as a socket 332 for receiving a recharging plug.

Figure 24:
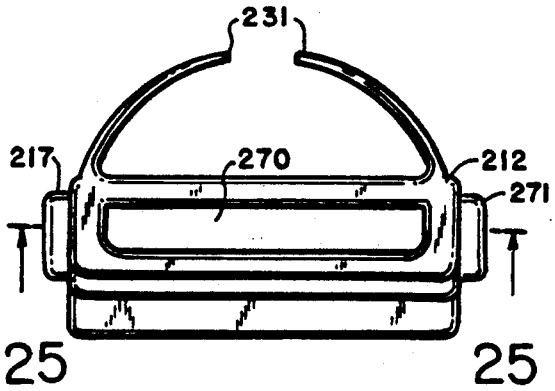
FIG. 24 is a side view of the battery assembly latch.
Figure 25:
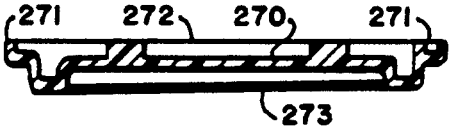
FIG. 25 is a cross sectional view of the latch of FIG. 24.

The latch 212, as illustrated in FIGS. 24 and 25, has a body portion 270 with a lateral guide projection 271 adapted to be received in suitable guide slots (not shown) in the housing 201 for guiding the latch toward and away from the battery assembly. A pair of spring fingers 231 depend from opposite sides of the top of the body portion 270 to extend through a recess in the housing 201, as seen in FIG. 4. The sides of the spring fingers 231 resiliently engage the sides of the recess through which they extend, to bias the latch 212 toward the battery assembly. The latch may be held to the housing 201 for limited by a projection 274 on the housing received in a recess 272 in the front of the latch, i.e. the side toward the housing. The rear of the latch may be provided with a recess 273 to enable the user to retract the latch for removal of the battery assembly.

Figure 27:
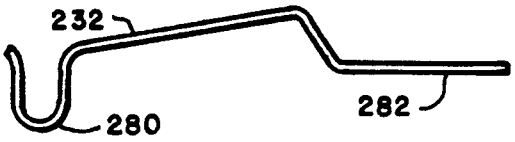
FIG. 27 is a side view of the battery contact finger of FIG. 26.
Figure 26:
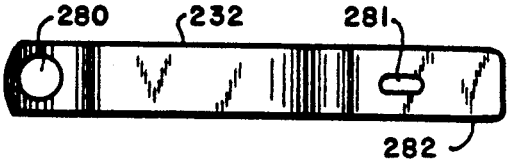
FIG. 26 is a front view of a battery contact finger.

FIGS. 26 and 27 illustrate the contacts 232 for engaging the battery assembly contacts 321. These contacts 232, which may be of a berylium copper alloy, are provided with a button 280 adapted to extend through a recess in the wall of the housing 201, to project resiliently into the recess 208. The contacts have a mounting hole 281 for mounting to the interior of the housing 201, the contacts being shaped between the hole 281 and button 280 to linearize the deflection of the button upon being contacted by the corresponding battery contact. The other end of the contact 232 is shaped as a spade connector 282 to facilitate the interconnection of the connector 232 and the circuitry within the vacuum cleaner.

Figure 28:
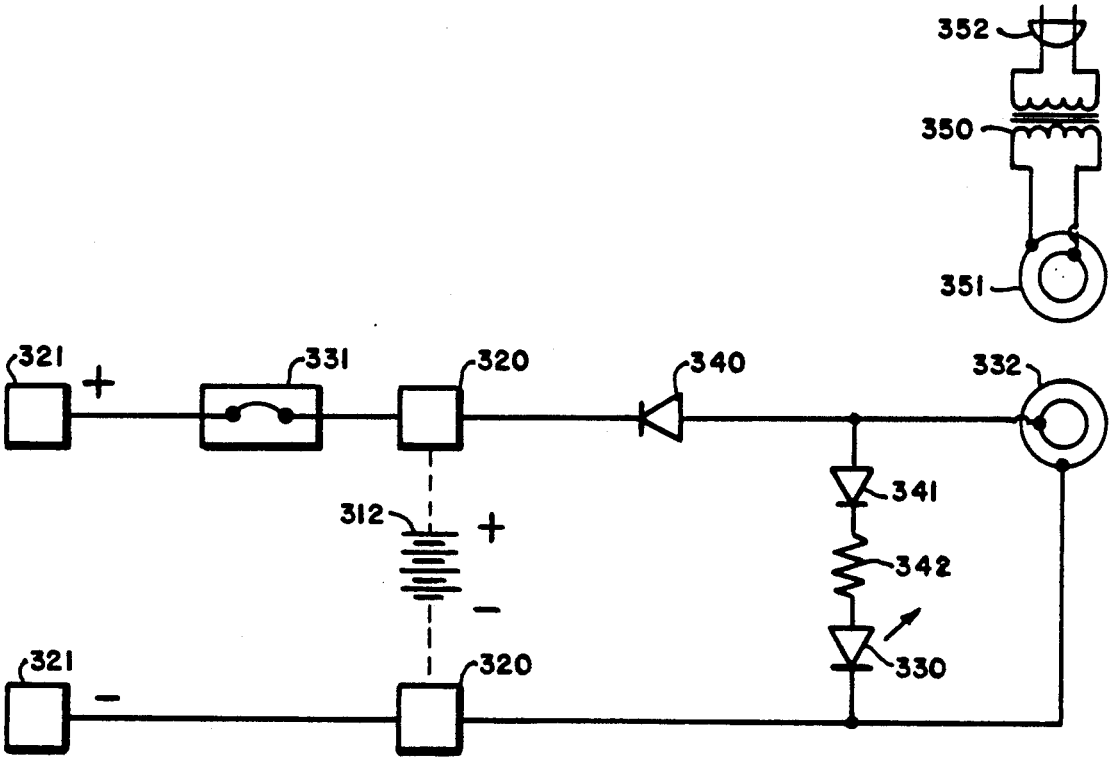
FIG. 28 is a circuit diagram of the circuit within the battery assembly.

The circuit provided within the battery assembly 300 is illustrated in FIG. 28, wherein it is seen that the terminals 320 of the battery 312 are connected to the contacts 321 via the circuit breaker 331. The socket 332 is connected to the battery 312 via a charging rectifier 340, for charging the battery. The charging voltage is applied to the charge indicator LED 330 via a diode 341 and resistor 342. It is to be noted that the battery may be charged either while it is positioned within the recess 208 of the vacuum cleaner, or it may be removed for such charging. The circuit breaker 331 protects the battery 312 from short circuits.

In order to enable charging of the battery, a step down transformer 350 may be provided having a secondary winding connected to a suitable plug 351 for being received by the socket 332, and a primary winding connected to a mains plug 352.

FIG. 29 illustrates the circuit provided on the control board 236. As illustrated, the input terminals 285, connected to the connectors 232, are connected to the center contact of the two sections of the control switch 258. This switch has an OFF position, a position in which just the motor in the ground engaging unit is on, and a position in which both the motor and the lamps are on. The central position is thus useful to save current from the battery, so that the vacuum cleaner may operate for a longer time between recharging.

The two ON contact positions of the lower switch section are connected to the coil of a relay 286, as well as to the center terminal of one relay contact 287. One ON contact of the upper switch section is connected to the circuit of the lamps. The relay is selected to release when the voltage applied to its coil falls below about 8.5 to 9.0 volts, in order to disconnect the battery from the motor and lamps in sufficient time to avoid a deep discharge of the battery that would affect the reliability of the battery.

The contacts 287 apply the battery voltage to the vacuum cleaner motor as well as to an LED driver circuit 289 for energizing the LEDs 259. The driver circuit 289 comprises a voltmeter circuit, for selectively energizing the LEDs 259 in dependence upon the battery voltage. Since the terminal voltage of the battery is a function of the charge state, the parameters of the driver circuit 289 may be set in conventional manner to indicate determined discharge states of the battery, such as, for example, 4/5 capacity remaining, 3/5 capacity remaining, etc. In a preferred embodiment of the invention, five LEDs 259 are provided to indicate five different charge conditions. Alternatively the energizing of the lamps may be an indication of operating time remaining.

Figure 31:
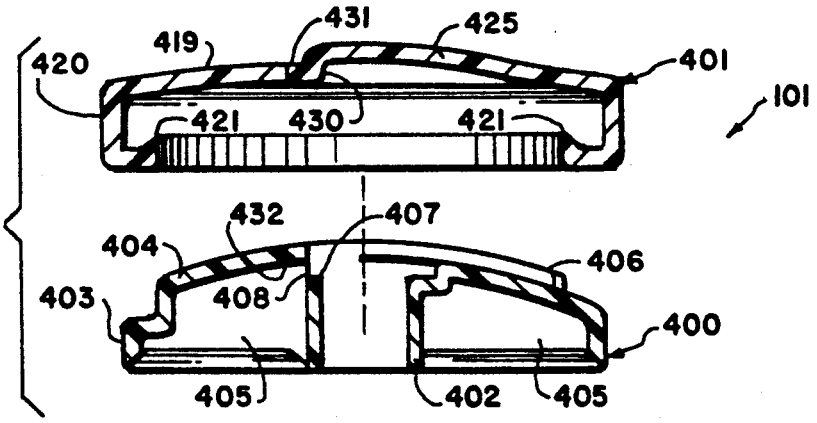
FIG. 31 is an exploded cross sectional view of the wheel assembly.
Figure 30:
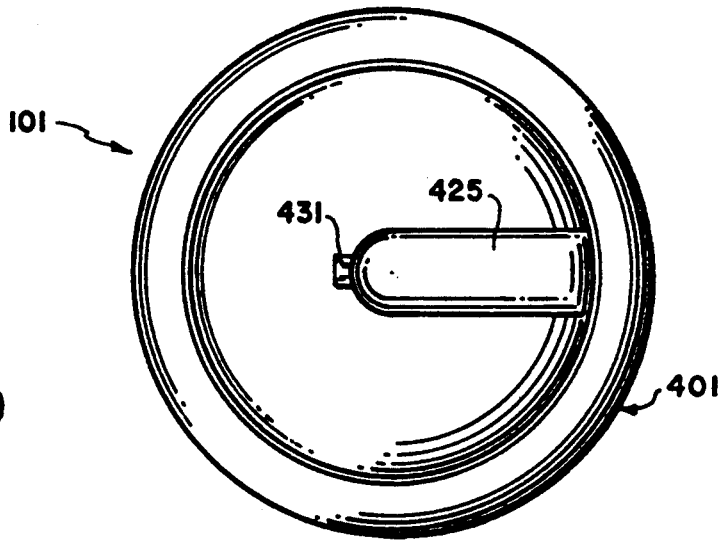
FIG. 30 is a side view of the wheel assembly.

As illustrated in FIGS. 30 and 31, the wheel assembly 101 for the rear wheel is comprised of a wheel 400 of rigid plastic, and a wheel cover 401 for example of flexible plastic. The wheel has a hub 402, an outer rim 403, a web 404 extending between the hub and the rim, and a plurality of radial internal strengthening fins 405. In addition, a parallel walled channel 406 extend from one edge to the center of the wheel, in which the web surface is depressed. The end 407 of the hub 402 toward the web is recessed, such that a gap 408 is defined at the inner end of the channel 406.

The wheel cover has a circular web 419 with an outer rim 420. The edge of the rim is bent under to define a lip 421 adapted to engage under the edge of the rim 403 of the wheel to firmly hold the wheel cover on the wheel. The web 419 of the wheel cover 401 has a hinged tab 421 partially severed therefrom, but remaining affixed to the wheel cover at its outer radial extremity. The tab 421 is shaped generally the same as the channel 406, and the wheel cover is affixed to the wheel with the tab aligned with the channel. The radially inner end of the tab has a catch projection 430 adapted to extend through the gap 408 when the wheel cover is mounted on the wheel, the projection 430 thus having an outer surface 431 adapted to engage the inner surface 432 of the web 404 adjacent the end of the channel, to hold the tab against the wheel.

In order to mount the wheel on the vacuum cleaner, the tab 425 is deformed to release the catch 430, and the tab is then hinged back. A suitable axle such as a mounting pin (not shown) is then inserted in the hole of the hub, with the head thereof engaging the end 407 of the hub. (The internal end of the pin may be affixed to the vacuum cleaner by any conventional means). The tab 425 is then returned to the channel and bent until the catch again engages the under surface 432 of the web 404. The tab thus serves to hide the mounting arrangement of the wheel in a simple manner while presenting a pleasing external appearance.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. A vacuum cleaner comprising:

a floor engaging unit including a vacuum nozzle, and a vacuum pump;

a handle assembly pivotally mounted to said floor engaging unit, said handle assembly including a housing having a removable cover, an externally accessible recess, electrical contacts in said recess, and a dirt tube in said housing having a port for removably receiving a porous dust bag;

a flexible tube arrangement coupling said dirt tube to said vacuum pump whereby dirt-laden air is drawn by said pump from said nozzle to be directed through said port;

means for connecting said electrical contacts to said vacuum pump;

a battery assembly in said recess and having battery contacts releasably contacting said electrical contacts; and means for releasably holding said battery assembly in said recess.

2. The vacuum cleaner of claim 1 wherein said electrical contacts comprise spring contact fingers adapted to engage said battery contacts only when said battery assembly is positioned within said recess.

3. The vacuum cleaner of claim 1 further comprising means for allowing pivotal assembly of said battery assembly in said recess.

4. The vacuum cleaner of claim 3 wherein said means for allowing pivotal assembly comprises projections within said recess and adjacent one end of said recess, and guide means on said battery assembly for releasably receiving said projections, said releasable holding means comprising a catch mounted on said housing at the end of said recess opposite said one end thereof and positioned to engage said battery assembly.

5. The vacuum cleaner of claim 1 wherein said battery assembly comprises a battery housing, a rechargeable battery within said housing, sand a circuit connecting said battery to said battery contacts, said circuit comprising a charging circuit and a manually operable circuit breaker.

6. The vacuum cleaner of claim 1 comprising indicating means on said housing, said indicating means comprising means coupled to said battery assembly for indicating the charge condition of said battery assembly.

7. The vacuum cleaner of claim 6 wherein said indicating means comprising a plurality of LEDs connected to be energized at different charge conditions of said battery.

8. In a vacuum cleaner including a floor engaging unit and a handle assembly pivotally mounted thereto, the floor engaging unit including an electrically operated vacuum pump, the improvement comprising a battery assembly removably mounted in said handle assembly, said battery assembly comprising a box adapted to be mounted in said housing and enclosing a battery for energizing said motor and a circuit including a charging circuit connected to said battery and a manually resettable circuit breaker connected to said battery and accessible from the exterior of said handle assembly.

9. In a vacuum cleaner having a vacuum pump for directing dust laden air from a nozzel to a dust container therein, said vacuum pump including a motor, and a rechargeable battery connected to energize said motor, the improvement comprising idicator means connected to said battery, said indicator means comprising a plurality of separate indicator lamps, each lamp discretely indicating a determined level of the state of charge of said battery.

10. In a vacuum cleaner having a vacuum pump for directing dust laden air from a nozzle to a dust bag removably mounted therein, said vacuum pump including a motor, said vacuum cleaner including a housing, the improvement comprising a recess in said housing for removable receiving a battery assembly, a pair of resilient contact fingers mounted to said housing and having first ends extending into said recess for contacting terminals of said battery and means for releasably connecting the other ends of said fingers to said motor.

11. The vacuum cleaner of claim 10 further comprising a battery assembly mounted in said recess, said housing having pivot projections extending into the sides of said recedes at one end thereof, said battery assembly including a battery box having battery terminals thereon, said battery box having pivot recesses in the sides at one ned thereof for receiving said pivot projections to permit said battery box to be releasably pivotally positioned in said recess, whereby said terminals slidingly engage said fingers during pivoting of said box into said recess, and latch means for releasably holding said battery box in said recess.

12. The vacuum cleaner of claim 11 wherein said battery box has a step, said terminals being positioned in said step, wherein said terminals cannot contact any planar surface upon which said battery box may rest.

13. In a vacuum cleaner including a floor engaging unit and a handle assembly pivotally mounted thereto the vacuum cleaner including an electrically operated vacuum pump, the improvement comprising a battery assembly removably mounted in said handle assembly, said battery assembly comprising a box adapted to be mounted in said housing and enclosing a battery for energizing said motor and a circuit including a charging circuit connected to said battery and a manually resettable circuit breaker connected to said battery and accessible from the exterior of said handle assembly.

* * * * *

UNITED STATES PATENT AND TRADEMARK OFFICE

CERTIFICATE OF CORRECTION

PATENT NO. : 5,014,388

DATED : May 14, 1991

INVENTOR(S) : Alfred Schiazza, et al.

It is certified that error appears in the above-identified patent and that said Letters Patent is hereby corrected as shown below:

Col. 9, line 68, "sand" should be --and--.

Col. 10, line 36, "removable" should be --removably--.

Signed and Sealed this

Eighth Day of September, 1992

*Attest:*

DOUGLAS B. COMER

*Attesting Officer*

*Acting Commissioner of Patents and Trademarks*